United States Patent [19]

Nishikawa et al.

[11] Patent Number: 4,626,107

[45] Date of Patent: Dec. 2, 1986

[54] STRUCTURE OF ROTATING MECHANISM FOR WATCH CASE

[75] Inventors: Junichi Nishikawa; Yutaka Shoji, both of Tokyo, Japan

[73] Assignee: Citizen Watch Co., Ltd., Tokyo, Japan

[21] Appl. No.: 781,250

[22] Filed: Sep. 27, 1985

[30] Foreign Application Priority Data

Oct. 1, 1984 [JP] Japan ..... 59-206090
Oct. 1, 1984 [JP] Japan ..... 59-148766[U]
Oct. 26, 1984 [JP] Japan ..... 59-162062[U]

[51] Int. Cl.[4] ..... G04B 37/00
[52] U.S. Cl. ..... 368/276; 368/309
[58] Field of Search ..... 368/88, 223, 228, 232, 368/233, 276, 281, 282, 294, 309

[56] References Cited

U.S. PATENT DOCUMENTS 3,382,666 5/1968 Gerry ..... 368/294
4,067,186 1/1978 Grohoski et al. ..... 368/294
4,253,177 2/1981 Hafner ..... 368/294
4,420,264 12/1983 Murata ..... 368/223

FOREIGN PATENT DOCUMENTS 55-70768 5/1980 Japan ..... 368/294
347780 7/1960 Switzerland ..... 368/294

*Primary Examiner*—Vit W. Miska
*Attorney, Agent, or Firm*—Koda and Androlia

[57] ABSTRACT

A structure of a rotating mechanism for a watch case having a time display section, comprising a case body internally accommodating the time display section and having a lower opening, a back cover fitted into the lower opening of the case body, a retining ring secured to a lower portion of the case body, and a band attaching base engaging with the case body by being clamped between the retaining ring and the case body. The case body is adapted to rotate with respect to the band attaching base.

7 Claims, 2 Drawing Figures

STRUCTURE OF ROTATING MECHANISM FOR WATCH CASE

BACKGROUND OF THE INVENTION

1. Field of the Invention

This invention relates to a structure of the watch case wherein a case body having a time display section rotates with respect to a band attaching base, particularly a rotating mechanism for the watch case.

2. Prior Art

A conventional structure of a rotating case of this type is disclosed in the specification of Japanese Utility Model Application Laid-Open No. 59-98385.

As shown in FIG. 19, the conventional structure includes an upper middle 10 internally accommodating a time display section having a dial, hands, movement and the like, a lower middle 12 to which a band 14 is attached, and a back cover 16 screwed securely and water-tightly into the upper middle 10 via a packing 18. The lower middle 12 is rotatably sandwiched between the upper middle 10 and the back cover 16. Further, the packing 20 is interposed between the back cover 16 and the lower middle 12 to get a suitable regulation of the rotation by friction produced between the back cover 16 and the packing 20.

In the prior art, in order to position the packing 20, a recess 16*a* is formed in the outer circumferential surface of the back cover 16. As a result, a shape of the back cover 16 becomes complicated and its height becomes higher. Further, the back cover 16 cannot be used in common in other watch cases, thus making it impossible to achieve standardization.

As shown in FIG. 20, the conventional structure further includes a hole 10*a* provided at a lower surface of the upper middle 10, a spring 22 adapted in the hole 10*a*, a ball 23 pressed by the spring 22 in the direction of the lower middle 12 and radial grooves 12*a*. The radial grooves 12*a* are formed at the upper face of the lower middle 12 as shown in FIG. 21. The ball 23 and the grooves 12*a* are engaged, therefore, when the upper middle 10 is rotated the feeling of a click operation is produced.

In the conventional structure, the upper middle 10 is able to rotate through 360° with respect to the lower middle 12. Consequently, when rotating the upper middle 10, the 12:00 position becomes indistinct. Thus, it is necessary to make the 12:00 indicator to stand out.

A further problem is that it is difficult to select a position at which the upper middle 10 is to be stopped in a case where the click groove structure is operated during the operation of a vehicle or the like.

SUMMARY OF THE INVENTION

Accordingly, it is the primary object of this invention to provide a structure of a watch case having a rotating mechanism without changing the shape of a back cover.

It is another object to provide a structure of a watch case, which structure produces good operational feeling and reliable operation.

In keeping with the principles of the present invention, the above-mentioned objects are accomplished by a structure of a rotating mechanism for a watch case, wherein a structure of a rotating mechanism for a watch case having a time display section, comprising: a case body internally accomodating said time display section and having a lower opening; a back cover fitted into said lower opening of said case body; a retaining ring secured to a lower portion of said case body; and a band attaching base engaging with said case body by being clamped between said retaining ring and said case body, said case body being adapted to rotate with respect to said band attaching ring.

BRIEF DESCRIPTION OF THE DRAWINGS

These and other objects and features of the present invention will become more apparent from the following description when taken in conjunction with the accompanying drawings, in which.

DETAILED DESCRIPTION OF THE INVENTION

Figure 1:
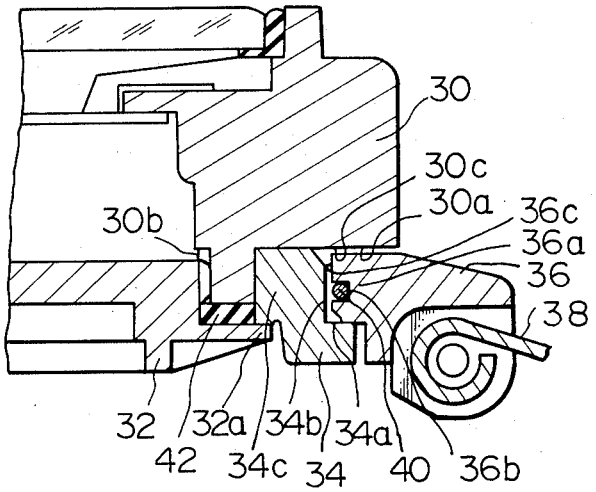
FIG. 1 is a sectional view illustrating a first embodiment of the present invention.

FIG. 1 is a sectional view illustrating a first embodiment of the present invention. Numeral 30 denotes a case body internally accommodating a watch display section and having an outwardly facing annular step 30*a* formed at a lower portion thereof.

Numeral 32 denotes a back cover fitted into a lower opening 30*b* of the case body 30 by being screwed into the opening 30*b*.

Numeral 34 denotes a retaining ring having a mounting portion 34*c* clamped between the step 30*a* of case body 30 and a peripheral portion 32*a* of the back cover 32. The outer circumferential portion of the retaning ring 34 is provided with a outwardly facing annular step 34*a*.

Numeral 36 denotes a ring-shaped band attaching base having a band 38 attached thereto. The band attaching base 36 has an engaging portion 36*a* formed on an inner circumferential side thereof and rotatably sandwiched between the step 34*a* of the retaining ring 34 and a horizontal surface 30*c* of the case body 30. The band attaching base 36 also has an annular groove 36*b* formed at an inner circumferential surface 36*c* thereof.

Figure 2:
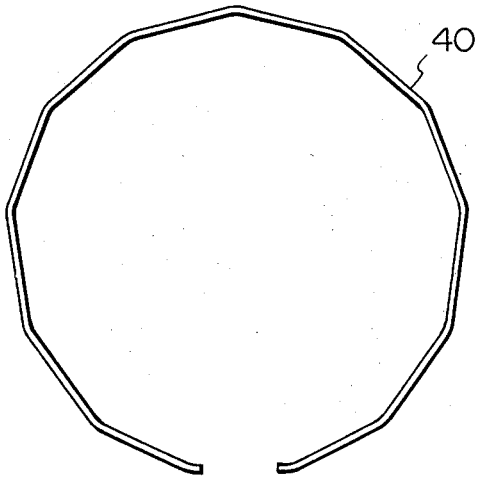
FIG. 2 is a plan view of a polygonal spring shown in FIG. 1.

Numeral 40 denotes a polygonal spring as shown in FIG. 2. The polygonal spring 40 is disposed in the annular groove 36*b* and comes in contact with a vertical surface 34*b* of the step 34*a* and an inner surface of the annular recess 36*b*.

Numeral 42 denotes a packing compressed by the case body 30, back cover 32 and retaining ring 34, thereby improving the watertightness of the interior of the watch case.

When the user holds the case body 30 and rotates that, the back cover 32 and retaining ring 34 are rotated together with the case body 30. Then, the rotation of the retaining ring 34 is suppressed and controlled by the spring 40 stretching between the retaining ring 34 and band attaching base 36.

In this embodiment, the case body 30 and band attaching base 36 are fitted together in a freely rotatable manner by the retaining ring 34. This makes it possible to simplify the structure of the back cover 32 and to employ a back cover which is commonly used.

Figure 3:
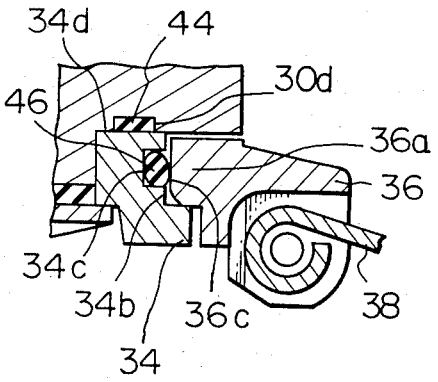
FIG. 3 is a sectional view illustrating a modification of the first embodiment shown in FIG. 1.

FIG. 3 shows a modification of the structure shown in FIG. 1. Like elements corresponding to those of FIG. 1 are indicated by like numerals.

In this modification, the case body 30 has an annular groove 30*d* formed at the horizontal surface 30*c* of the step 30*a*, and also an annular groove 34*c* is provided with the vertical surface 34*b* of the retaining ring 34 together with omitting the annular groove 36*b* of the band attaching base 36.

Further, packings 44 ans 46 are employed. The packing 44 is received in the annular groove 30*d* of the case body 30 and is compressed between the case body 30 and an upper surface 34*d* of the retaining ring 34. The packing 46 is received in the annular groove 34*c* of the retaining ring 34 and is compressed betweeen the retaining ring 34 and the inner circumferential surface 36*c* of the band attaching base 36.

In this modification, the packing 44 produces a large frictional force between the case body 30 and retaining ring 34, thereby acting substantially integrate the case body 30 and retaining ring 34. Further, a frictional force is produced between the packing 46 and band attaching base 36, so that the packing 46 acts to suitably suppress rotation.

Figure 4:
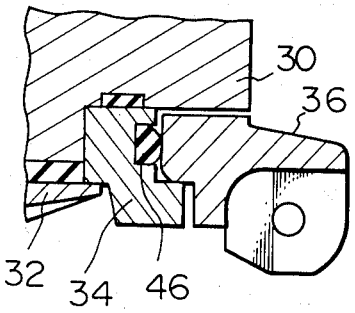
FIGS. 4 and 5 show examples of a packing shown in FIG. 3.
Figure 5:
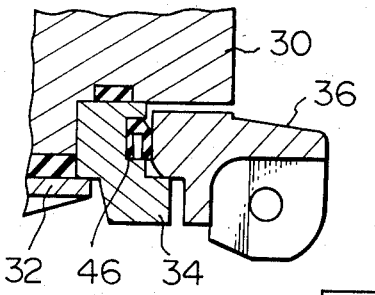

It is of course possible to use the polygonal spring 40 in place of the packing 46. Furthermore, besides using an O-ring such as shown in FIG. 3 as the packing 46, it is able to use a packing having a bead-shaped or C-shaped cross section, as shown in FIGS. 4 and 5, respectively.

In the present modification, the rotation of the case body 30 is controlled by the packing 46 which is provided on the side of the rotating ring 36.

Figure 6:
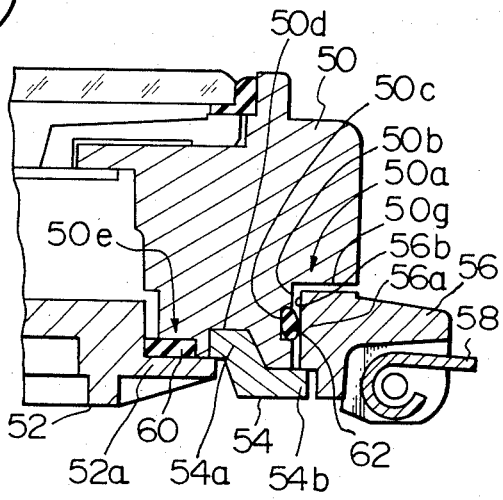
FIG. 6 is a sectional view illustrating a second embodiment of the present invention.

FIG. 6 is a sectional view illustrating a second embodiment of the present invention. Numeral 50 denotes a case body the lower circumferential porti on of which is provided with a step 50*a* having a vertical surface 50*b* provided with an annular groove 50*c*. The case body 50 also has an annular recess 50*d* formed at the lower surface thereof and has an inwardly facing step 50*e* formed on its lower, inner circumference.

Numeral 52 denotes a back cover fitted into a lower opening 50*f* of the case body 50 as being screwed into the opening.

Numeral 54 denotes a retaining ring of generally Z-shaped cross section suitable for the annular recess 50*d* of case body 50 and having a mounting portion 54*a* fixedly clamped between the peripheral portion 52*a* of back cover 52 and the case body 50 and having an engaging portion 54*b* projecting below the step 50*a* of case body 50.

Numeral 56 denotes a ring-shaped band attaching base having a band 58 attached thereto. The band attaching base 56 has an engaging portion 56*a* fitted into the step 50*a* of case body 50 and sandwiched between a horizontal surface 50*g* of the case body 50 and the engaging portion 54*b* of retaining ring 54, whereby the band attaching base 56 is rotatably attached to the case body 50.

Numeral 60, 62 designate packings. The packing 60 is received in the step 50*e* of case body 50 and is compressed between the case body 50 and the peripheral portion 52*a* of back cover 52 to assure the waterproof property of the interior of the case. The packing 62 is received in the annular groove 50*c* of case body 50 and acts to produce a suitable frictional force between the case body 50 and the inner circumferential surface 56*b* of the band attaching base 56.

Figure 7:
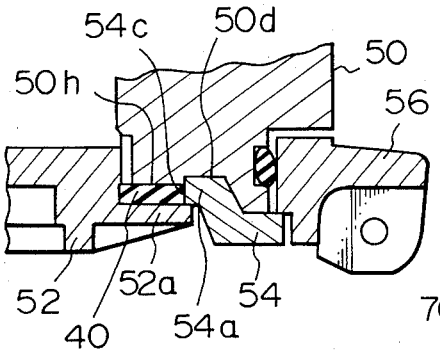
FIG. 7 is a sectional view illustrating a modification of the second embodiment shown in FIG. 6.

As shown in FIG. 7, the step 50*e* of case body 50 may be modified into a surface 50*h* continuous with the recess 50*d*, and the packing 60 may be so arranged as to be compressed by the surface 50*h*, the peripheral portion 52*a* of the back cover 52 and the inner circumferential surfaace 54*c* of the retaining ring 54. It is also possible to use the polygonal spring 40 in place of the packing 46.

The case body 50 of the present embodiment is also attached as illustrated in the foregoing arrangement so as to be freely rotatable with respect to the band attached base 56. Rotation of the case body 50 is controlled by the packing 62 which is provided on the side of the case body 50.

Figure 8:
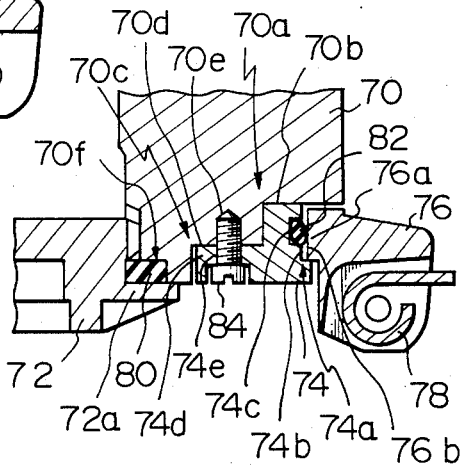
FIG. 8 is a sectional view illustrating a third embodiment of the present invention.

FIG. 8 is a sectional view illustrating a third embodiment of the present invention. Numeral 70 denotes a case body having an outwardly facing first annular step 70*a* provided at the lower circumferential portion. The case body 70 also has an outwardly facing second annular step 70*c* underlying the step 70*a*, and a screw hole 70*e* is formed at the horizontal surface 70*d* of the second annular step 70*c*. The lower circumferential portion of the case body 70 is also provided with an inwardly facing third annular step 70*f*.

Numeral 72 denotes a back cover fitted into a lower opening of the case body 70 with its peripheral portion 72*a* compressing a packing 80 received in the step 70*f* of the case body 70.

Numeral 74 designates a retaining ring of generally L-shaped cross section having an outwardly facing step 74*a* formed at the lower part of the outer circumference thereof. The step 74*a* has a vertical surface 74*b* provided with an annular groove 74*c* accommodating a packing 82. The retaining ring 74 also has an engaging portion 74*d* in contact with the horizontal surface 70*d* of the case body 70. The engaging portion 74*d* has a through-hole 74*e* formed at a position corresponding to the screw hole 70*e* of case body 70.

Numeral 76 denotes a ring-shaped band attaching base having a band 78 attached thereto. An engaging portion 76*a* thereof is clamped between the horizontal surface 70*b* of case body 70 and the step 74*a* of retaining ring 74, whereby the band attaching base 76 is attached to the case body 70 in such a manner that the packing 82 is pressured by an inner circumferential surface 76*b* of the band attaching base 76.

Numeral 84 denotes a screw that is screwed into the screw hole 70*e* of the case body 70 via the through-hole 74*e* of retaininf ring 74.

Since the retaining ring 74 in the present embodiment is attached to the case body 70 by the screw 84, the arrangement is such that the case body 70 can be detached from the band attaching base 76 without removing the back cover 72.

Figure 9:
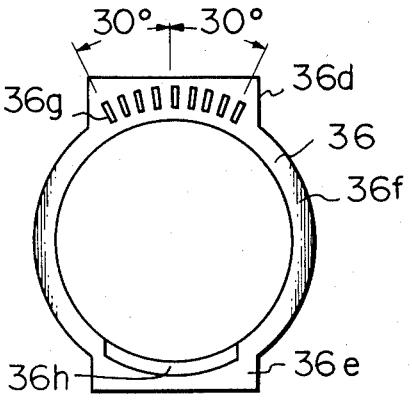
FIGS. 9 and 10 are plan and bottom views of a band attaching base and a case body, respectively, according to a modification of each of the abovementioned embodiments of the present invention.
Figure 10:
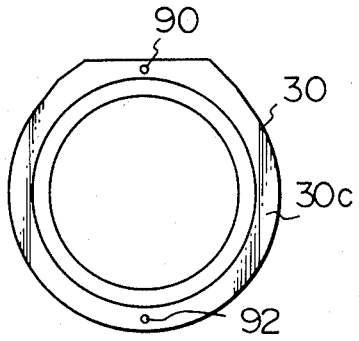

FIG. 9 is a plan view of a band attaching base according to a modification of each of above-mentioned embodiments of the present invention, and FIG. 10 is a bottom view of a case body according to this modification, with like parts bearing the same reference numerals as those used in FIG. 1. The present modification includes adding a click groove structure to the case body rotating structure such as structures shown in FIGS. 1 to 8. Accordingly, the modification based on the first embodiment shown in FIG. 1 is only described as an example.

The band attaching base 36 illustrated in FIG. 9 has a generally ring-shaped configuration and is provided with band attaching portions 36*d*,36*e* at the 12:00 and 6:00 positions, respectively.

The case body 30 shown in FIG. 10 also has a ring-shaped configuration. The band attaching base 36 and case body 30 are fitted together by the retaining ring 34, described above, so as to be freely rotatable.

The band attaching base 36 has an upper surface 36*f* which opposes the case body 30 when the band attaching base 36 and case body 30 are fitted together. The band attaching base 36 also has a plurality of radially extending click grooves 36*g* and a rotation limiting groove 36*h* provided at the 12:00 and 6:00 positions, respectively, and formed along the contour of the band attaching base 36.

As shown in FIG. 9, the click grooves 36*g* and rotation limiting groove 36*h* are provided over a range extendig 30° to either side of the 12:00 position and 6:00 position.

A pivot 90 and a pin 92 are implanted in the lower surface 30*f* of the case body 30 opposing the band attaching base 36 and fitted into the click grooves 36*g* and rotation limiting 36*h* of the band attaching base 36 when the case body 30 and band attaching base 36 are assembled.

Figure 11:
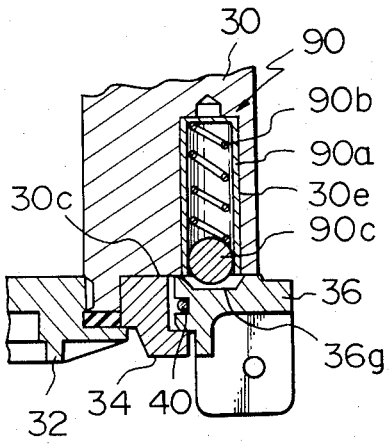
FIGS. 11 and 12 are partial sectional views illustrating the 12:00 position and 6:00 position, respectively, when the band attaching base and case body shown in FIGS. 9 and 10 are fitted together.
Figure 12:
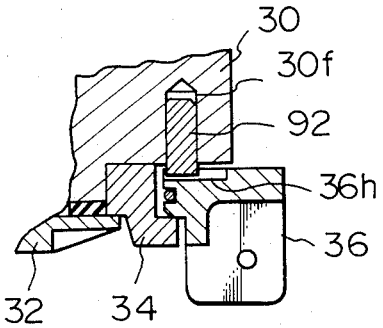

FIGS. 11 and 12 are partial sectional views illustrating the 12:00 position 6:00 position, respectively, when the band attaching base 36 and case body 30 are fitted together.

A hole 30*e* which opens to the side of the lower surface 30*c* is provided in the case body 30. The pivot 90 is press-fitted into the hole 30*e*. The pivot 90 is composed of a pipe 90*a*, a spring 90*b* accommodated in the pipe 90*a*, and a ball 90*c* pushed by the spring 90*b*. The ball 90*c* projects from the opening of the hole 30*e* in case body 30. Accordingly, when the case body 30 is rotated, the ball 90*c* pushed by the spring 90*b* falls into the click grooves 36*g* and rises up pn the surface 36*f* of the band attaching base 36 to produce the feeling of a click operation.

As shown in FIG. 12, a hole 30*f* opening to the side of the lower surface 30*c* is provided in the case body 30 at the 6:00 position. The pin 92 is pressfitted into the hole 30*f* and projects into the rotation limiting groove 36*h* provided in the band attaching base 36. When the case body 30 is rotated and the angle of rotation reaches a limit value, the pin 92 comes into abutting contact with the edge of the rotation limiting groove 36*h* at one end thereof.

In this modification, it is possible to set the case body to the optimum position very easily during the driving of a vehicle or the like without visually confirming position. Furthermore, the region in the vicinity of the band attaching portions of the band attaching base is only utilized for providig the click groove, thus it is possible to reduce a thickness of the portion other than the band attaching portions.

Figure 13:
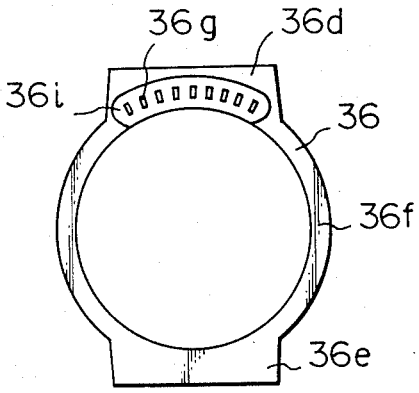
FIGS. 13 and 14 are plan and bottom views of the band attaching base and case body according to another modification of at least the first embodiment.
Figure 14:
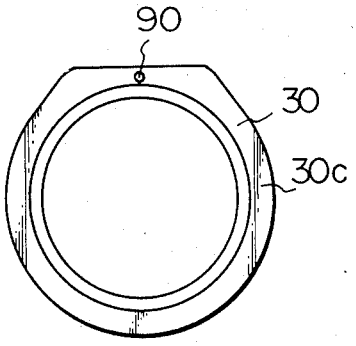

FIG. 13 is a plan view of the band attaching base according to another modification of at least first embodiment, and FIG. 14 is a bottom view of a case body according to this modification. Like elements corresponding to those of FIGS. 9 and 10 are indicated by like numerals.

As in the above-mentioned modification, the band attaching base 30 shown in FIG. 13 has band attaching portions 36*d*, 36*e* and click grooves 36*g*. A rotation limiting groove 36*i*, which acts in the same manner as the rotation limiting groove 36*h* shown in FIG. 9, is provided along the periphery of the click grooves 36*g* of the present modification and is shallower in depth than the click grooves 36*g*.

A case body 30 shown in FIG. 14 is provided only with a pivot 90 at the 12:00 position.

Figure 15:
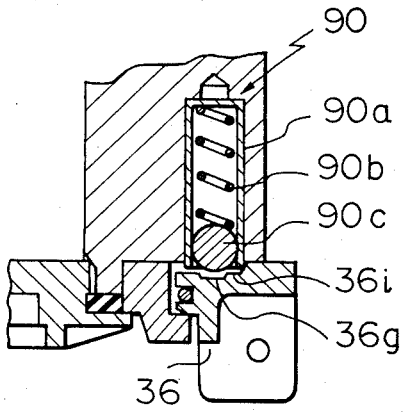
FIG. 15 is a partial sectional view illustrating the 12:00 position when the band attaching base and case body shown in FIGS. 13 and 14 are fitted together.

As shown in FIG. 15, in this modification, the ball 90*c* and the end portion of the pipe 90*a* project from the opening of the hole 30*e*. As a result, when the case body 30 is rotated, the ball 90*c* falls into the click grooves 36*g* of the band attaching base 36 and rises up onto the floor surface of the rotation limiting groove 36*i* to produce the feeling of a click operation. When the angle of rotation of case body 30 reaches a limit value, the end portion of pipe 90*a* of pivot 90 projecting from the hole 30*e* comes into abutting contact with the edge of the rotation limiting groove 36*i*, thereby limiting rotation.

Figure 16:
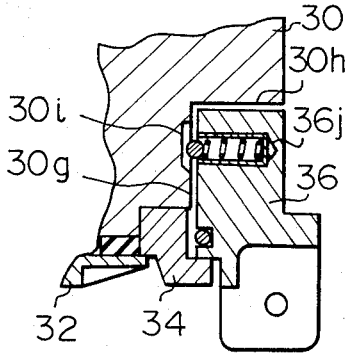
FIG. 16 is a partial sectional view illustrating still another modification of at least the first embodiment.

FIG. 16 is a partial sectional view illustrating still another modification of at least first embodiment shown in FIG. 1. In this modification, a surface such as an outer circumferential surface 30*g* or lower surface 30*h* of a case body 30 that opposes a band attaching base 36 is provided with click grooves 30*i* that extend over an angle of rotation having a maximum value of 60°. Further, a rotation limiting groove is formed on the outer circumferential surface 30*g* or lower surface 30*h*, just as in above-mentioned modifications. In this modification, the pivot 90 is press-fitted into a hole 36*j* formed in the band attaching base 36. Then, the feeling of a click operation is produced by the pivot 90.

According to all of the above-mentioned embodiments, it is possible to employ a back cover which is used for the other watch case. Therefore, it is possible to employ a specific back cover as described hereinbelow.

Figure 17:
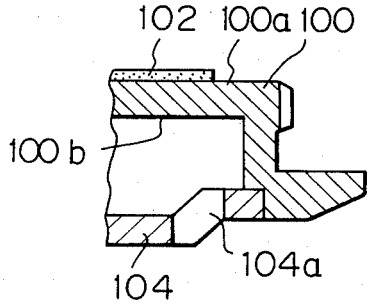
FIG. 17 is a sectional view illustrating a back cover which can be used for the structure of the present invention.

FIG. 17 is a sectional view illustrating a back cover which can be used for the structure of the present invention.

A back cover body 100 has an upper surface 100*a* to which a piezoelectric element 102 is affixed to provide the back cover with a piezoelectric buzzer function.

The back cover body 100 also has a recess 100*b* formed on a lower surface thereof. A sound diaphragm 104 made of metal and having a sounf emitting hole 104*a* is attached to the back cover body 100 by being press-fitted into the back cover so as to cover the recess 100*b*. It is possible to attach the sound diaphragm 104 to the back cover by bonding , brazing or welding.

Figure 18:
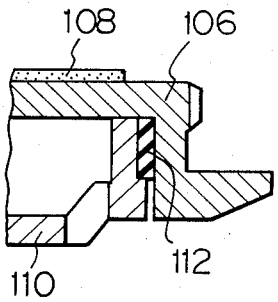
FIG. 18 is a sectional view illustrating another back cover which can be used for the structure of the present invention.
Figure 19:
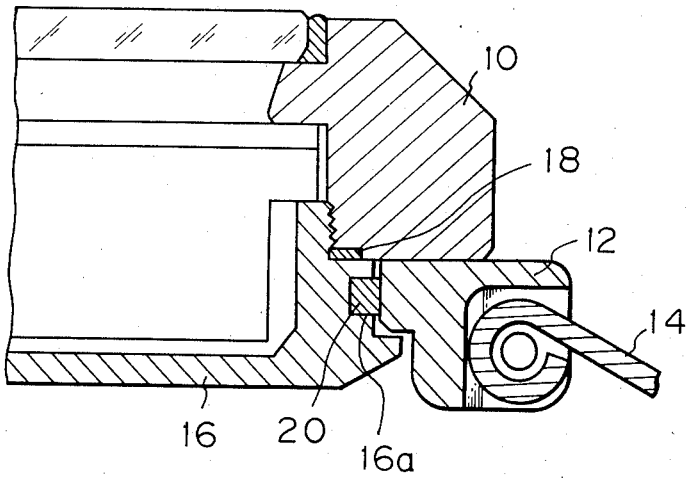
Fig. 19 PRIOR ART
FIG. 19 is a sectional view illustrating a rotating mechanism of a conventional rotating case.
Figure 20:
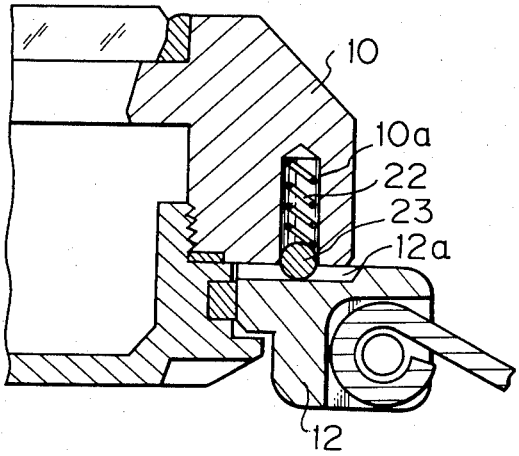
Fig. 20 PRIOR ART
FIG. 20 is a sectional view illustrating the structure of a conventional rotating case.
Figure 21:
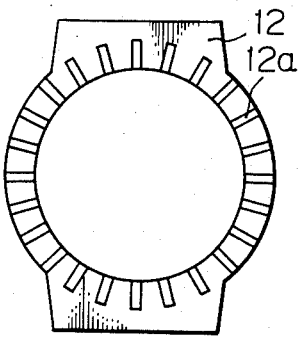
Fig. 21 PRIOR ART
FIG. 21 is a plan view of a lower middle shown in FIG. 20.

FIG. 18 showa the sound diaphragm 110 attached via a waterproof packing 112 to the back cover body 106 having the piezoelectric element 108 affixed thereto.

Accordig to the present invention, the case body and band attaching base are fitted together in a freely rotatable manner by the retaining ring. This makes it possible to simplify the structure of the back cover and to employ a back cover which is used for the other watch case. In addition, the retaining ring can also be mounted on a band attaching base having different specifications merely by modifying the retaining rig without altering the case body or back cover.

We claim:

1. A structure of a rotating mechanism for a watch case having a time display section, comprising:

a case body internally accommodating said time display section and having a lower opening;

a back cover fitted into said lower opening of said case body;

a retaining ring secured to a lower portion of said case body; and a band attaching base engaging with said case body by being clamped between said retaining ring and said case body, said case body being adapted to rotate with respect to said band attaching base.

2. A structure of a rotating mechanism for a watch case according to claim 1, further comprising rotation control means provided between said retaining ring and said band attaching base.

3. A structure of a rotating mechanism for a watch case according to claim 1, further comprising rotation control means provided between said case body and said band attaching base.

4. A structure of a rotating mechanism for a watch case according to claim 2 or 3, said rotation control means includes a polygonal spring or a packing.

5. A structure of a rotating mechanism for a watch case according to claim 1, further comprising a pivot provided in one of the opposing surfaces of said band attaching base and case body and having a ball which resiliently moves in and out at the end portion thereof, and a plurality of click grooves provided on the other of the opposing surfaces of said band attaching base and case body in a predetermined angle corresponding to the angle of rotation of said case body, said ball of said pivot falling into said click grooves when said case body is rotated.

6. A structure of a rotating mechanism for a watch case according to claim 5, further comprising a rotation limiting grooves provided on one of the opposing surfaces of said band attaching base and case body, and a pin provided in the other of the opposing surfaces of said band attaching base and case body and projecting into said rotation limiting groove, in which said pin comes into contact with an edge of said rotation limiting groove to limit rotation of said case body when said case body is rotated.

7. A structure of a rotating mechanism for a watch case according to claim 5, further comprising a rotation limiting groove provided along the periphery of said click grooves, said rotation limiting groove being shallower than said click groove, and wherein said pivot has a pipe supporting said ball and having an end portion projecting into said rotation limiting groove, in which the end portion of said pipe of said pivot comes into contact with an edge of said rotation limiting groove to limit rotation of said case body.

* * * * *